US005765630A

United States Patent [19]

Bloomer

[11] Patent Number: 5,765,630

[45] Date of Patent: Jun. 16, 1998

[54] RADIATOR WITH AIR FLOW DIRECTING FINS

[75] Inventor: Stephen Francis Bloomer, Lambeth, Canada

[73] Assignee: Siemens Electric Limited, Mississauga, Canada

[21] Appl. No.: 716,010

[22] Filed: Sep. 19, 1996

[51] Int. Cl.[6] ..... F27F 13/06; F28D 1/053

[52] U.S. Cl. ..... 165/121; 165/152; 415/183; 415/208.2

[58] Field of Search ..... 165/121, 122, 165/152, 153; 415/182.1, 183, 208.1–208.3

[56] References Cited

U.S. PATENT DOCUMENTS

| | | | |
|---|---|---|---|
| 2,378,372 | 6/1945 | Whittle | 415/183 X |
| 2,641,442 | 6/1953 | Buchi | 415/208.2 X |
| 2,953,295 | 9/1960 | Stalker | 415/208.1 X |
| 4,144,933 | 3/1979 | Asselman et al. | 165/153 X |
| 4,510,991 | 4/1985 | Kawahira | 165/122 X |

*Primary Examiner*—Leonard R. Leo

[57] ABSTRACT

An improved radiator core assembly for typical automotive and similar uses comprises fins angled with respect to the plane of the radiator core. Air entering the radiator is redirected by the fins to match the angle of the blades of a fan forcing air through the radiator.

11 Claims, 4 Drawing Sheets

RADIATOR WITH AIR FLOW DIRECTING FINS

FIELD OF THE INVENTION

This invention relates to an improved radiator, typically for automotive use. More particularly, the invention relates to an automotive radiator having higher air flow velocity and therefore greater cooling capacity for a given fan speed and size.

BACKGROUND

Due to the fundamental laws of thermodynamics, any prime mover, that is, any machine generating power by combustion, must reject excess heat generated by combustion. Where the prime mover is an internal combustion engine as employed in land vehicles, such as automobiles, trucks, diesel-electric locomotives, or motorcycles, or in stationary machines, such as engine-driven air compressors or generators, heat is typically removed by coolant pumped through the engine to a radiator, where the coolant is cooled by heat exchange with the atmospheric air, and returned to the engine in a complete loop.

A typical radiator comprises an inlet tank or manifold supplying hot coolant to the inlet ends of a large number of tubes and an outlet manifold, connected to the outlet ends of the tubes, collecting the cooled coolant. Air flows between the tubes, cooling the coolant. Heat-conducting fins in thermally-conductive relationship with the tubes carrying the coolant increase the surface area exposed to the flow of air, increasing the efficiency of cooling for a radiator of a given size.

Radiators as typically employed for vehicles are mounted such that motion of the vehicle in its normal direction of travel forces a steady flow of air between the tubes of the radiator carrying the coolant. However, vehicle radiators are normally also provided with cooling fans to ensure sufficient air flow through the radiator to provide adequate heat exchange at all times. Where the fan is continuously engine driven, it may consume substantial horsepower; for this reason, vehicle radiator fans are often powered by an electric motor wired in series with a thermostat, such that the electric motor is only actuated when actually needed, e.g., when the vehicle is stopped in traffic. Fans are uniformly provided to ensure air flow over the radiators of stationary equipment.

Such combinations of radiators and fans are well known. However, although radiator design and radiator manufacturing technology are very well developed, reduction in size, weight, and complexity are always desired.

OBJECTS OF THE INVENTION

It is therefore an object of the invention to provide a radiator providing increased efficiency in removal of heat, such that the overall radiator assembly can be made smaller and lighter, and/or the size or power requirement of the radiator fan can be reduced.

SUMMARY OF THE INVENTION

In conventional radiators, the fins secured in heat exchange relationship to the tubes carrying the coolant are essentially perpendicular to both the tubes and the plane of the radiator, such that air flowing through the numerous passages formed between adjacent tubes and pairs of fins passes straight through the radiator. Where a fan is employed to pull air through the radiator, the air stream must make a relatively abrupt turn to flow along the fan blades, meaning that a substantial amount of the fan's power is consumed by changing the direction of the flow of the air rather than urging the air through the radiator per se. According to the invention, the fins are angled or curved such that air flowing through the passages between the fins is directed towards the fan blades. Therefore, the fan need not be powered to change the direction of flow of the air; the fan merely increases the velocity of the air flowing through the radiator. The result is higher air flow velocity for a given fan speed. Accordingly, for a given cooling capacity, the radiator and fan can be made relatively smaller when implemented according to the invention.

BRIEF DESCRIPTION OF THE DRAWINGS

The invention will be better understood if reference is made to the accompanying drawings, in which.

DESCRIPTION OF THE DRAWINGS

Figure 1:
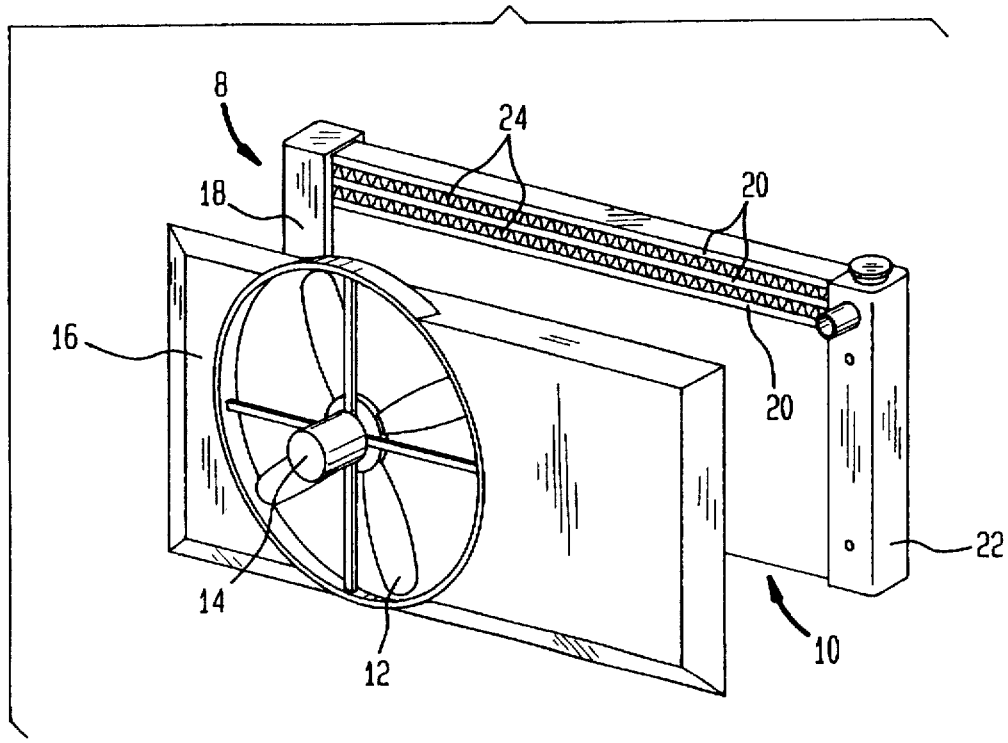
FIG. 1 (PRIOR ART)
FIG. 1 shows an exploded perspective view of a conventional radiator, fan, and fan shroud assembly.

FIG. 1 shows, as mentioned, an exploded view of a conventional radiator assembly including a radiator 8, and a fan 12 driven by a motor 14. The fan 12 and motor 14 are supported by a shroud 16 typically molded of plastic and mounted to radiator 8 to control air flow therethrough. The radiator 8 shown is a typical cross-flow design, wherein hot coolant is introduced to a tank or manifold 18 on one side and flows through a radiator core 10 comprising a number of spaced parallel tubes 20, three tubes 20 being shown in FIG. 1, to a second collection tank 22 on the other side of the radiator core 10. Many other equivalent arrangements are of course well known. Coolant flowing in tubes 20 is cooled by heat exchange with atmospheric air flowing between the tubes, generally perpendicular to the plane of the core 10. In order to increase the heat exchange surface for efficient cooling, fins 24 are typically soldered or brazed between the coolant tubes 20.

As discussed above, under many circumstances the velocity of the vehicle is sufficient to force an adequate stream of cooling air through the radiator. In such cases, fan 12 may be thermostatically controlled, e.g., to be driven by motor 14 only when the vehicle is at idle or a traffic light or the like. However, many vehicles and most stationary engines are provided with engine-driven fans which run at all times. The teachings of the present invention are equally applicable to both types of systems.

Figure 2:
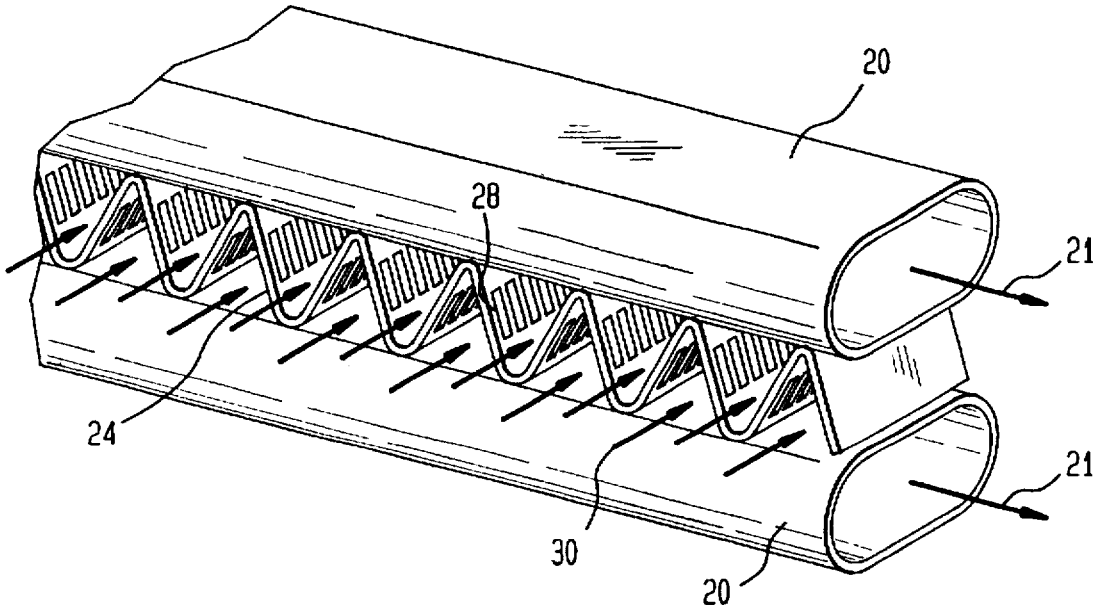
FIG. 2 (PRIOR ART)
FIG. 2 shows an enlarged view of the water coolant tubes of a conventional radiator and of the fins secured in heat transfer relationship therebetween.

FIG. 2 shows the structure of core 10, comprising tubes 20 and fins 24, in more detail. As indicated by arrows 21, coolant flows through spaced parallel tubes 20, between tanks 18 and 22 (FIG. 1). Fins 24 may be formed of corrugated sheet metal having good heat transfer characteristics, soldered or brazed to tubes 20 for carrying the coolant to be cooled. Other methods of assembling fins to coolant tubes 20 are known. As illustrated, fins 24 are typically punched with a series of louvers 28 to further increase the surface area available to be cooled by the air and thus improve the heat transfer.

Figure 3:
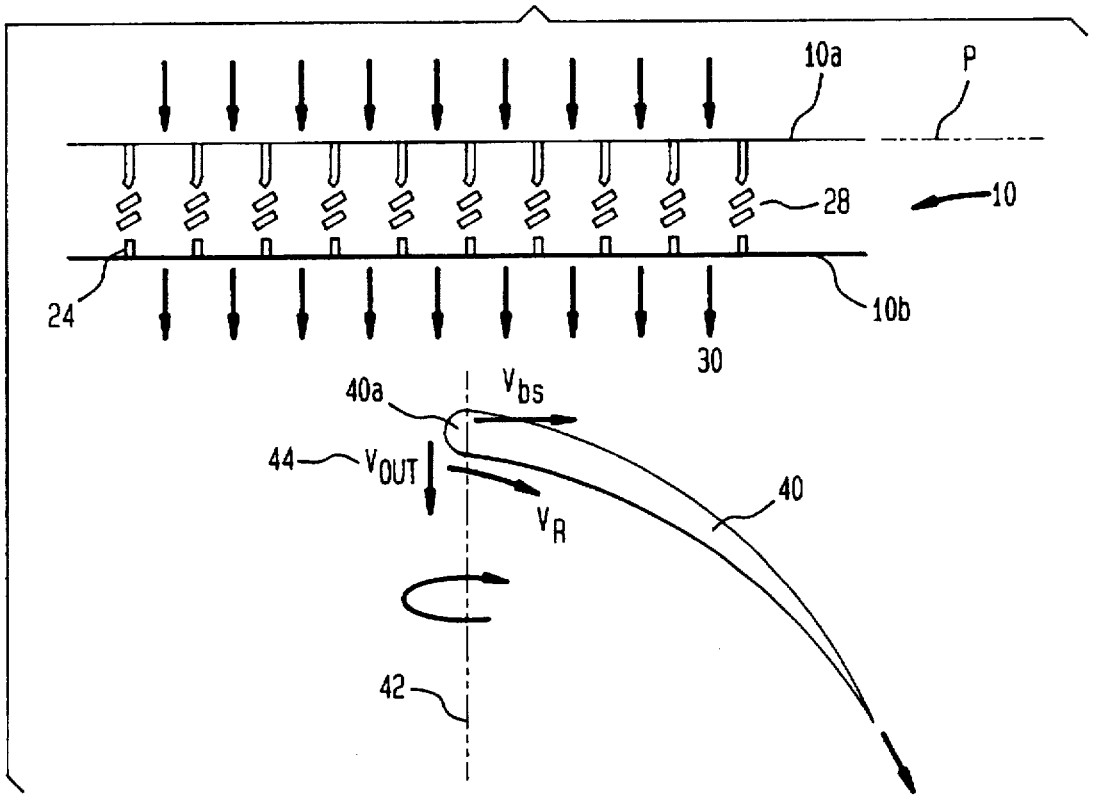
FIG. 3 (PRIOR ART)
FIG. 3 is a schematic cross-sectional view through the fins of a conventional radiator and one of the blades of the fan.

Air flow through the fins 24 is generally perpendicular to the plane defined by the opposed faces of the radiator core 10, as shown by arrows 30. That is, in the conventional radiator assembly shown in FIGS. 1–3, fins 24 are generally perpendicular to tubes 20, and also extend perpendicular to the planes of the faces of the core assembly 10. Hence the passages formed between adjacent tubes and fins are perpendicular to the core 20, and air flows through the radiator essentially normal to the plane of the core. FIG. 3 shows the fins 24 of the prior art radiator in cross-section; the manner in which fins 24 may be punched to form louvers 28 will be readily apparent to those of skill in the art. The direction of air flow is essentially perpendicular to a plane P parallel to the faces 10*a*, 10*b* of the core 10, as shown by arrows 30.

One of the blades 40 of a typical fan 12 is also shown in cross-section in FIG. 3. The fan is driven to rotate about an axis 42 shown in dot-dash lines, e.g. corresponding to the axis of motor 14 or of a drive pulley driving fan 12. The local velocity of the leading edge 40*a* of blade 40 is $V_{bs}$. The velocity $V_{out}$ of the air leaving the radiator core 10 is essentially normal to the plane of the faces 10*a*, 10*b* of the core, as indicated above. Rotation of the fan draws a stream of air through the radiator. The air stream follows a resultant path $V_R$ essentially conforming to the shape of the fan blade 40 Accordingly, a substantial amount of the fan's rotational energy is expended in changing the direction of the air stream essentially from $V_{out}$ to $V_R$. This expenditure of energy does not contribute to cooling the coolant. Eliminating this useless expenditure of energy would permit reducing the size of the fan. Alternatively, employing the same amount of energy to increase the velocity of the air stream through the radiator, e.g., by employing a faster-rotating fan, would increase the rate of heat transfer and permit employment of a smaller radiator.

Figure 4:
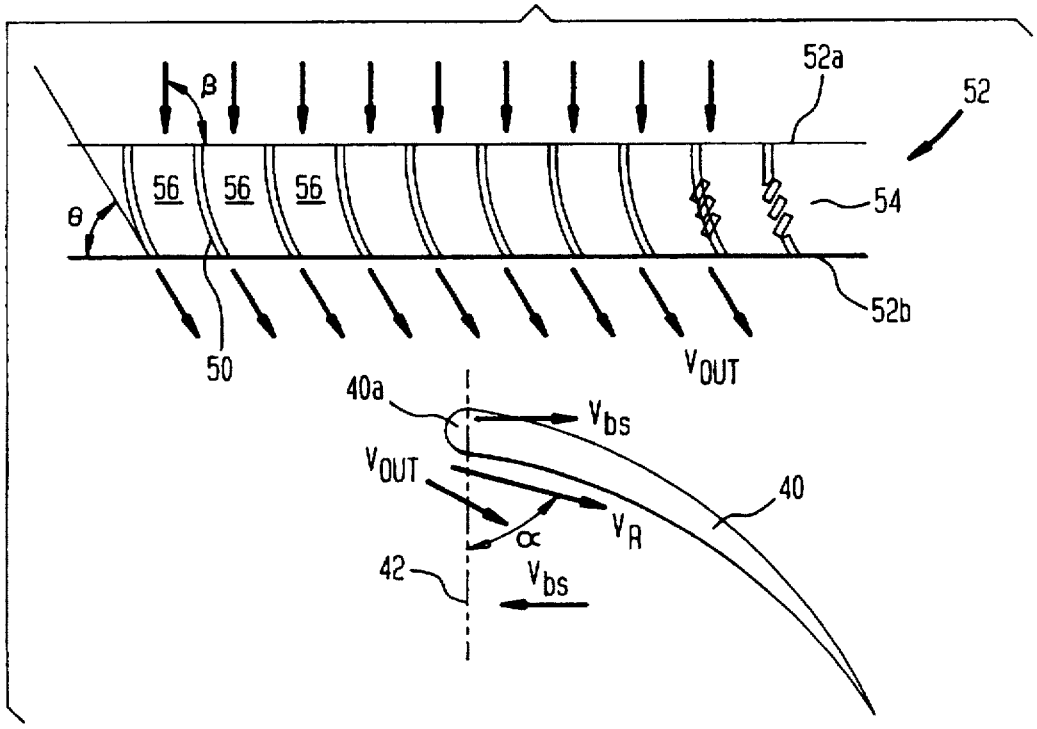
FIG. 4 shows a similar view with respect to the improved radiator and fan of the invention.

FIG. 4 shows the radiator core according to the invention. Here the fins 50 are again generally perpendicular to the spaced parallel coolant-containing tubes, but are curved in the plane perpendicular to the faces 52*a*, 52*b* of the core 50. Accordingly, the stream of air entering inlet face 52*a* of the core 52 according to the invention at an angle β, typically 90°, is curved by the curved fins 50 so as to exit the exit face 52*b* at an angle θ substantially corresponding to the angle at which the fins 50 intersect the exit face 52*b* of the core 52.

More specifically, ideally the angle θ at which the fins 50 intersect the exit face 52*b* (and at which the air stream exits the passages 51 formed between the tubes and fins) is essentially complementary to the angle α at which the leading edge 40*a* of the fan blade 40 intersects its axis 42. That is, angles α and θ sum substantially to 90°. In this way the air stream exiting the core flows smoothly along the fan blades 40, so that the fan need not be driven to expend significant energy in altering the direction of flow of the air stream. Furthermore, alteration of the direction of the air flow through angle θ by the fins 50 will result in more efficient heat transfer due to increasing turbulence of the air stream within the passages 51 formed between adjacent pairs of fins 50 and the coolant tubes.

As indicated at 54, the fins 50 may be louvered, as discussed above, to increase their surface area. While some of the air will flow through louvers 54, the direction of flow of the bulk of the air will nonetheless be altered through angle θ as indicated.

As indicated above, in the ideal case, the fins would be curved or angled such that the angle θ at which the air leaves the core 54 would be complementary to the angle α at which the air flow is incident on the rotating fan blade 40. Because the fan blades are rotating around their axis, this condition could be most readily achieved if the radiator were similarly circularly symmetric, for example, if the air flowed through a circular section of the radiator having fins disposed between circular coolant tubes, such that at all positions of the fan the air stream will be incident on the fan blade at the complementary angle. Such an embodiment of the invention is within its scope, and is discussed below in connection with FIG. 9.

However, in many cases it is desired to make a rectangular radiator. For manufacturing efficiency, the orientation of the fins must be maintained consistent within each of several regions of the radiator. As the rectangular radiator is not circularly symmetric, precise complementarity will be achieved only with respect to a few fins in each of the regions. However, the condition of complementarity is substantially achieved in each region, and a notable performance gain is still achieved. This embodiment is also considered to be within the scope of the invention.

Figure 5:
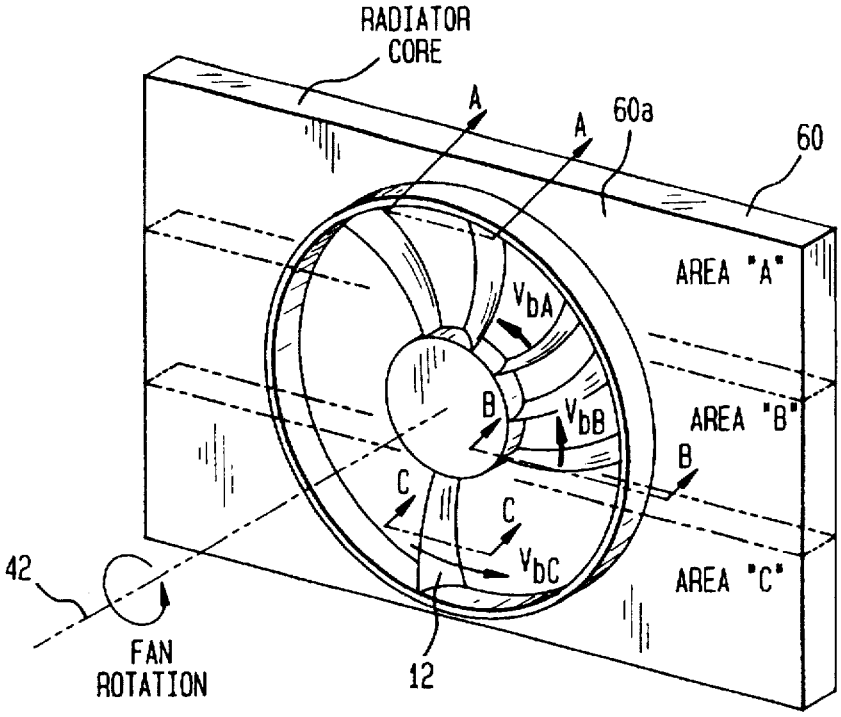
FIG. 5 shows a perspective view of a radiator core and fan combination according to the invention.
Figure 6:
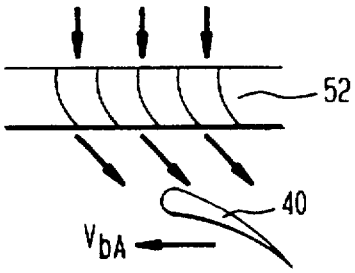
FIG. 6 shows a schematic cross-sectional view taken along line A—A of FIG. 5.
Figure 7:
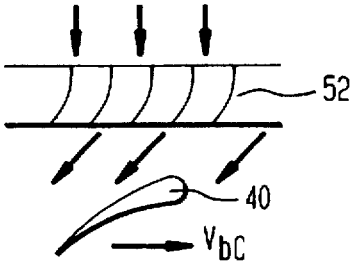
FIG. 7 shows a similar view taken along line C—C of FIG. 5.
Figure 8:
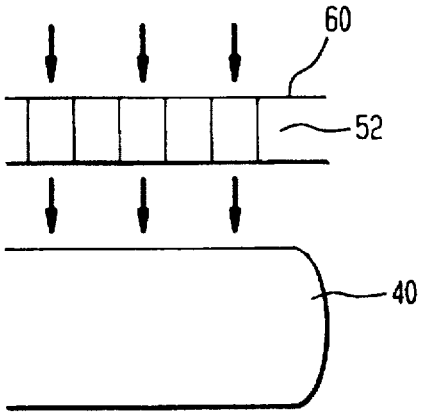
FIG. 8 shows a similar view taken along line B—B of FIG. 5.

FIG. 5 provides an example of such construction and is explained further by FIGS. 6 through 8. More specifically, FIG. 5 shows a radiator core 60 which may be considered essentially a direct replacement for the radiator core 10 of FIG. 1 as shown. Fan 12 is essentially conventional; the fan shroud and motor are not shown, to simplify the view. The radiator core 60 in this embodiment is divided into three regions, labeled areas A, B, and C. The fins 52 are oriented consistently within each region for manufacturing efficiency. However, the fins 52 are oriented differently in the different regions, corresponding to the relative position of the region with respect to the fan 12, so as to achieve the condition of substantial complementarity of the angle of the fins at the exit side 60*a* of the core 60 in each region with respect to the fan blades.

More specifically, FIG. 6 shows a schematic cross-sectional view of the fins 52 along cross-section A—A, taken in the upper portion of core 60. This view corresponds to FIG. 4.

FIG. 7 shows a corresponding view of the alignment of fins 52 in region C, the lower portion of the radiator core 60. The view is essentially a mirror-image of that shown in FIG. 6, in that the relative orientation of fins 52 is reversed so as to again be substantially complementary to the fan blade in the opposite side of its rotation.

Finally, FIG. 8 shows the orientation of the fins 52 in region B, which includes the axis of rotation of the fan. Here, the fins 52 may be essentially perpendicular to the plane of the core 60, generally as in the prior art. Alternatively, the relative orientation of the tubes and fins could be exchanged in region B with the fins oriented oppositely on either side of the axis of the fan.

It would of course be possible to divide the core 60 according to the invention into more than three regions or areas so as to more closely achieve the condition of complementarity of the exit angles of the fins 52 and the leading edges 40*a* of the fan blades 40. Therefore, numerous further embodiments of the invention are considered to be within its scope.

It will be appreciated by those of skill in the art that it would be relatively difficult to form the corrugated fin structure shown in FIG. 2 to be curved with respect to the plane of the core; as a compound curve would be formed, the corrugated structure might tend to kink. Therefore, it might be preferable to manufacture the radiator according to the invention by inserting the tubes in holes punched in curved fins; the length of each fin would correspond to the height of the corresponding section of the core 60.

Returning briefly to discussion of FIG. 4, it will be appreciated that the fins 50 are curved such that the angle β at which the fins 50 meet the entry face 52*a* of the core 52 is less than the angle θ at which they meet exit face 52*b*. It is also within the scope of the invention for the fins simply to be angled with respect to the faces 52*a* and 52*b*. Similarly, while the definition of complementarity given herein is with respect to the leading edge 40*a* of the blade 40, the fan blade 40 could simply be a flat plane at a continuous angle of attack defined by angle α at which blade 40 is disposed with respect to the motor axis 42.

Figure 9:
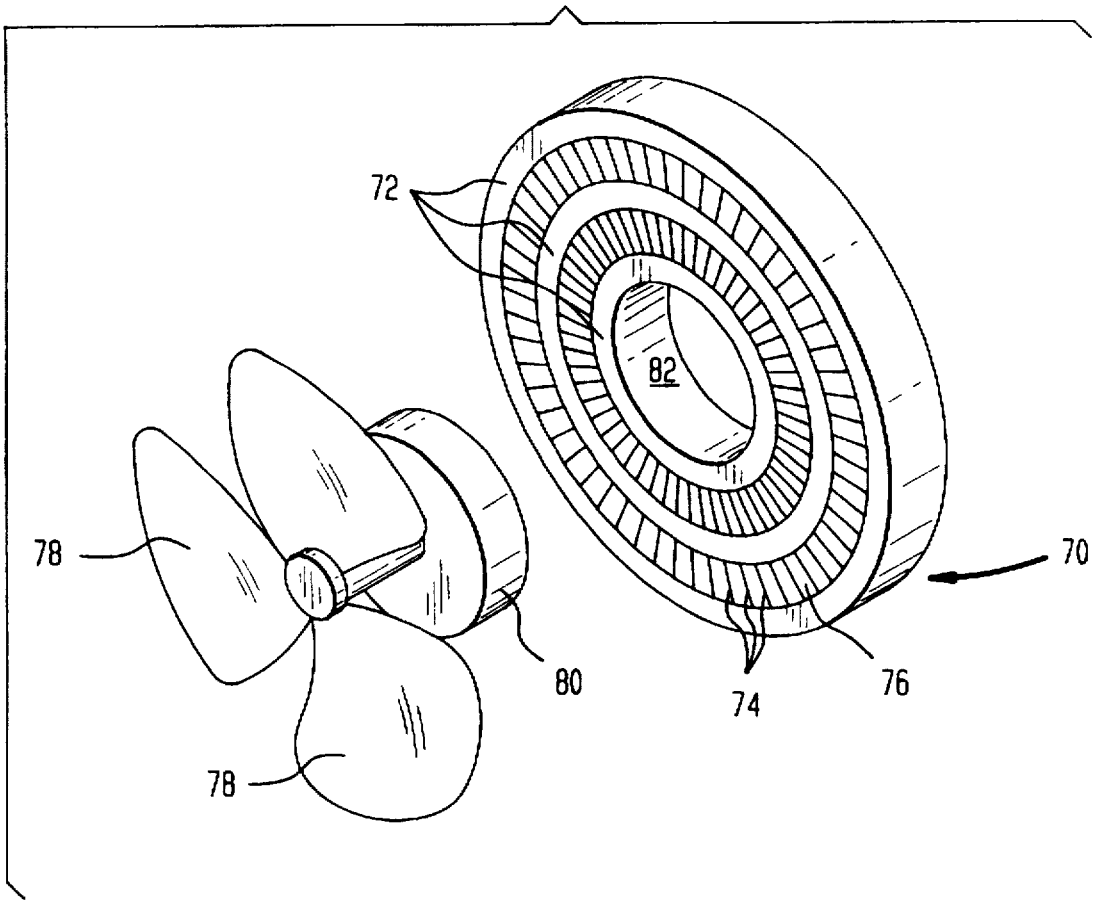
FIG. 9 shows a perspective view of a second embodiment of a radiator and fan assembly according to the invention.

Other embodiments within the scope of the invention include the circular radiator core 70 with concentric tubes 72 shown in FIG. 9. Fins 74 are essentially radial with respect to tubes 72, but are angled with respect to the plane of the core 70, so that the angles θ at which fins 74 the meet exit face 76 of the core are essentially complementary to the angle α of the leading edges of the fan blades. As the radiator is symmetrical around the axis of motor 80, the condition of complementarity is uniformly satisfied at all points around the axis. In a particularly preferred embodiment the fan motor 80 could be made to fit within the center 82 of the circular radiator core 70, resulting in a very compact and efficient arrangement while still providing substantial cooling.

It will therefore be appreciated that providing radiator fins curved with respect to the plane of the radiator provides increased cooling efficiency, in that the power provided by the fan is essentially employed only for increasing the velocity of the air and not for altering its direction. This allows reduction in the size of the fan for a given velocity, or increasing the airflow velocity for a given fan; both would improve overall cooling efficiency. As a subsidiary advantage, providing curved or angled fins according to the invention would provide additional structural rigidity to the core.

It will also be appreciated that the teachings of the invention could be applied to a combination of a radiator and a fan, the fan being juxtaposed to the inlet side of the radiator instead of the exit face as shown. In that case the fins would be oriented so that air would enter the passages between the tubes and fins at an angle corresponding to the angle of the fan blades, and be redirected by curved fins to exit substantially perpendicular to the exit face of the radiator.

Therefore, while a number of preferred embodiments of the invention have been shown and described in detail, the invention is not to be limited by the above exemplary disclosure, but only by the following claims.

What is claimed is:

1. An improved radiator core assembly, said core assembly comprising a number of spaced tubes for carrying coolant to be cooled, and a number of fins extending between adjacent ones of said spaced tubes and secured in heat-transfer relationship thereto, opposed faces of said core assembly defining a plane, said core assembly being mounted in a predetermined juxtaposed relation to a fan driven to spin about an axis generally perpendicular to the plane of said core assembly, said fan comprising a plurality of blades mounted at an angle to said axis in order to draw air through said core assembly, said fins forming angles with respect to the plane of said core assembly, said angles formed by said fins with respect to said plane varying in correspondence to the position of the fins with respect to the axis of said fan, whereby the angles made by the fins with respect to said plane are substantially complementary to the angle of the blades of the fan with respect to the axis about which said fan spins.

2. The improved radiator core assembly of claim 1, wherein said blades of said fan are curved, and the angles of the fins with respect to the plane of said core assembly at the face of the core assembly juxtaposed to said fan are substantially complementary to the angles of the blades with respect to the axis of the fan where the blades are juxtaposed to the core assembly.

3. The improved radiator core assembly of claim 1, wherein said fins are curved between a first face of said core to which said fan is juxtaposed and an opposite second face of said core, such that the fins are disposed at smaller angles to said plane where said fins meet said first face than where said fins meet said second face.

4. The improved radiator core assembly of claim 1, wherein said core assembly is divided into regions, the angles made by the fins with respect to said plane being consistent throughout each of said regions.

5. The improved radiator core assembly of claim 4, wherein the relative orientation of the angles of said fins in regions of said core assembly on opposed sides of said axis of said fan are substantially mirror-imaged with respect to one another.

6. An improved assembly of a radiator for containing coolant to be cooled by exposure of said radiator to a stream of air and a fan driven to force a stream of air through said radiator, said radiator comprising inlet means for receiving a stream of coolant to be cooled, a plurality of tubes in communication with said inlet means, a number of fins secured between said tubes in heat transfer relation therewith, and an outlet means connected to said tubes for collecting cooled coolant therefrom, said tubes and fins comprising a generally planar core assembly having a first face juxtaposed to said fan and a second face opposed to said fan, said fan being mounted in predetermined juxtaposed relation to said first face of said radiator, said fan comprising a number of blades mounted on a shaft such that a leading edge of each said blade is disposed at an angle of attack α to the atmosphere when said shaft is driven, said fins and said tubes being secured to one another such that a plurality of air passages are formed by adjacent pairs of tubes and fins, said fins being mounted with respect to the plane of said core assembly such that air flowing through said passages passes through said first face juxtaposed to said fan at an angle θ substantially complementary to said angle of attack α made by the leading edges of said fan blades.

7. The improved assembly of claim 6, wherein said fins are shaped such that the angle θ at which air passes through said first face juxtaposed to said fan is smaller than an angle β at which air passes through said second face.

8. The improved assembly of claim 7, wherein said fins are shaped such that the angle β at which air passes through said second face is substantially 90°.

9. The improved assembly of claim 6, wherein said assembly is employed for cooling coolant of a motor vehicle having a prevailing direction of travel, and said assembly is mounted such that when said vehicle is traveling in said prevailing direction of travel, air flows into said passages from said second face and exits said passages from said first face, said fan being mounted behind said radiator with respect to said prevailing direction of travel.

10. The improved assembly of claim 6, wherein said radiator core assembly is generally rectangular, said tubes being disposed in spaced parallel relation to one another, and said fins being substantially perpendicular to said tubes.

11. The improved assembly of claim 10, wherein said rectangular core assembly is divided into sections, the fins in each section being consistently oriented with respect to the plane of said core, the orientation of said fins in each of said sections being selected in correspondence to the position of the section with respect to the axis of the fan.

* * * * *